US009943389B2

(12) United States Patent
Chen

(10) Patent No.: US 9,943,389 B2
(45) Date of Patent: Apr. 17, 2018

(54) PLUG OF ARTIFICIAL INSEMINATION TUBE FOR LIVESTOCK BREEDING

(71) Applicant: Sheng-Jui Chen, Taoyuan (TW)

(72) Inventor: Sheng-Jui Chen, Taoyuan (TW)

( * ) Notice: Subject to any disclaimer, the term of this patent is extended or adjusted under 35 U.S.C. 154(b) by 254 days.

(21) Appl. No.: 14/991,047

(22) Filed: Jan. 8, 2016

(65) Prior Publication Data

US 2017/0112606 A1 Apr. 27, 2017

(30) Foreign Application Priority Data

Oct. 26, 2015 (TW) ..... 104217130 U

(51) Int. Cl.
*A61D 19/02* (2006.01)

(52) U.S. Cl.
CPC ..... *A61D 19/027* (2013.01)

(58) Field of Classification Search
CPC ..... A61D 19/027
USPC ..... 600/33–35
See application file for complete search history.

(56) References Cited

U.S. PATENT DOCUMENTS 3,507,281 A * 4/1970 Cassou ..... A61D 19/027 604/232
5,674,178 A * 10/1997 Root ..... A61B 17/43 600/35
2002/0038113 A1* 3/2002 Gourley ..... A61D 17/002 604/515
2004/0089312 A1* 5/2004 Jordan ..... A61B 17/425 128/887
2005/0028824 A1* 2/2005 Jordan ..... A61B 17/425 128/830
2006/0079731 A1* 4/2006 Chen ..... A61D 19/027 600/35
2007/0255091 A1* 11/2007 Ainley, Jr. ..... A61D 19/027 600/35
2009/0163765 A1* 6/2009 Chen ..... A61D 19/027 600/35
2010/0179378 A1* 7/2010 Chen ..... A61D 19/027 600/35
2010/0331610 A1* 12/2010 Chen ..... A61D 19/027 600/35

(Continued)

FOREIGN PATENT DOCUMENTS

WO WO 2009097872 A1 * 8/2009 ..... A61D 19/027

*Primary Examiner* — Navin Natnithithadha
*Assistant Examiner* — Sunita Reddy
(74) *Attorney, Agent, or Firm* — Rosenberg, Klein & Lee

(57) ABSTRACT

A plug of an artificial insemination tube for livestock breeding includes a leading portion and a viewing portion, each having different color layers or different hardness layers, and being formed by stacking and combining different foam layers. In an artificial insemination for livestock breeding, the plug installed at the front of a sperm delivery duct is inserted into a reproductive organ of the livestock, and secretion or fluid is attached and shown on surfaces of the plug leading portion and the viewing portion with different colors to achieve the effect of detecting the physical and physiological conditions of the livestock. In addition, the leading portion is a foam layer with relatively greater hardness, density, and smoothness, so that the plug may be entered into the female livestock body more easily, and the injection hole will not be deformed easily, so as to improve the smoothness and efficiency of the artificial insemination.

9 Claims, 3 Drawing Sheets

(56) References Cited

U.S. PATENT DOCUMENTS

2011/0087065 A1* 4/2011 Liu ..... A61D 19/027
600/35

* cited by examiner

PLUG OF ARTIFICIAL INSEMINATION TUBE FOR LIVESTOCK BREEDING

TECHNICAL FIELD

The technical field relates to a plug of an artificial insemination tube for livestock breeding, and more particularly to the plug with the features of simple installation and operation and easy and convenient use and capable of improving the efficiency of artificial insemination, and concurrently having the functions of guiding an artificial insemination and detecting the physical conditions of livestock, and the plug of the artificial insemination tube for livestock breeding is very practical, useful, and inventive.

BACKGROUND

With reference to FIG. 1 for a conventional artificial insemination tube for livestock breeding, the artificial insemination tube is mainly divided into two types, and each includes a sperm delivery duct 10, and a plug 20 installed at the front of the sperm delivery duct 10, wherein the plug 20 is an integral soft foam member and has a sleeve aperture 201 formed at the center of the plug 20 for installing and fixing the sperm delivery duct 10, an injection hole 202 with an appropriate length and a diameter slightly smaller than the front adjacent to the sleeve aperture 201, so that after the sperm delivery duct 10 are installed to the sleeve aperture 201, the front of the sperm delivery duct 10 will not be penetrated through or exposed from the injection hole 202. When an artificial insemination is applied to the livestock, the plug 20 is inserted slowly along the vagina of the livestock and entered into the uterus through the cervix, and then livestock semen stored in a semen bottle (or bag) is injected from the rear of the sperm delivery duct 10, and the injection hole 202 of the plug 20 enters into the uterus, so as to complete the artificial insemination procedure of the livestock.

Wherein, a soft plug 20 guided and entered into the uterus of the livestock reproductive organ has the effects of making the artificial insemination operation smoother and reducing the chance of injuring the reproductive organ. Undeniably, the soft plug 20 provides the aforementioned effects in applications, and thus is the most popular method used in the industry at present. However, the soft plug 20 still has the following drawbacks after a long time of use.

1. Since the plug 20 is an integral soft foam member, therefore the plug 20 enters into the vagina by pushing when the plug 20 enters into a female livestock body, and the front of the plug 20 is often compressed improperly, and the injection hole 202 may be deformed, decreased, narrowed, or even blocked. As a result, the artificial insemination efficiency is reduced.

2. Since the plug 20 is an integral soft foam member, the foam material (such as ethylene vinyl acetate (EVA)) for making the plug 20 is often foamed to a smaller density in order to maintain the overall softness of the plug 20, and the whole peripheral surface of the plug 20 is not of high density or smoothness. When the plug 20 is pushed and squeezed into the female livestock body, the operation is unsmooth, and sometimes even brings discomfort to the female livestock body.

3. Since the plug 20 is integrally formed and made by foaming a foam material, therefore the softness, hardness, and color of the plug 20 are fixed, and the scope of applicability of the artificial insemination tube is limited.

With reference to FIG. 2 for another conventional artificial insemination tube made of rubber, this artificial insemination tube comprises a sperm delivery duct 10 and a plug 20 integrally formed with each other and made of rubber, wherein the plug 20 is generally formed into a spiral shape and has an external diameter slightly smaller than the plug of the aforementioned foam member, which is a plug used for an artificial insemination tube. The spiral plug with a smaller diameter may be extended to a deeper position of the female livestock body to achieve the effect of a better hit rate of the artificial insemination, and such artificial insemination tube made of rubber has a relatively higher hardness, so that the injection hole 202 will not be deformed or blocked easily during the artificial insemination procedure. Since the plug 20 has a smooth surface, therefore it can enter into the female livestock body easily. However, the whole plug made of a hard material may bring discomfort to the female livestock body during the artificial insemination procedure due to improper operations or may even cause injuries, so that the application of such plug is usually restricted to professionals or technicians only and has the drawbacks of limiting its use by professionals and hurting the female livestock body. In addition the artificial insemination tube made of rubber comes with fixed softness, hardness, and color, and thus the scope of applicability is limited.

SUMMARY

Therefore, it is a primary objective of this disclosure to overcome the aforementioned drawbacks of the prior art by providing a plug of an artificial insemination tube for livestock breeding and extending the scope of applicability of the artificial insemination tube used for livestock breeding to achieve a diversified application and improve the operation and efficiency of the livestock artificial insemination.

To achieve the aforementioned objective, this disclosure provides a plug of an artificial insemination tube, comprising: a leading portion and a viewing portion, both made of a foam material and foamed to form foam layers which are stacked and coupled integrally, and the leading portion and viewing portion formed by stacking the foam layers being different hardness layers or different color layers respectively. In an artificial insemination of the livestock, the plug installed at the front of a sperm delivery duct is inserted into a reproductive organ of the livestock, and then secretion or fluid is attached and shown onto the surfaces of the leading portion and the viewing portion of the plug of different colors, so as to achieve the effect of detecting the physical and physiological conditions of the livestock. In addition, the leading portion is a foam layer with relatively greater hardness and density, so that the plug may enter into the female livestock body easily, and the injection hole will not be deformed easily, so as to improve the smoothness and efficiency of the artificial insemination.

This disclosure will become clearer in light of the following detailed description of an illustrative embodiment of this invention described in connection with the drawings.

DESCRIPTION OF THE PREFERRED EMBODIMENTS

Figure 1:
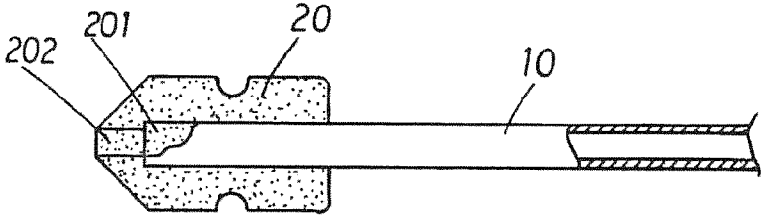
FIG.1 PRIOR ART
FIG. 1 is a front view of a conventional plug of an artificial insemination tube for livestock breeding.
Figure 2:
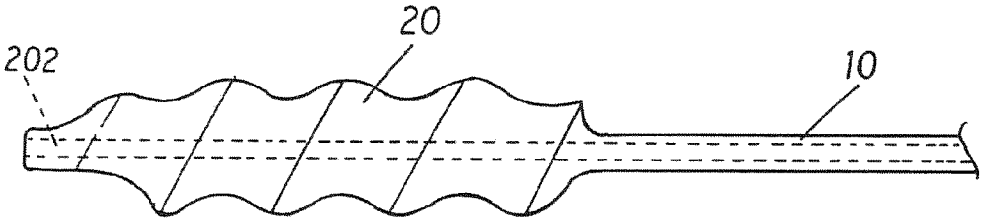
FIG.2 PRIOR ART
FIG. 2 is a front view of another conventional plug of an artificial insemination tube for livestock breeding.
Figure 3:
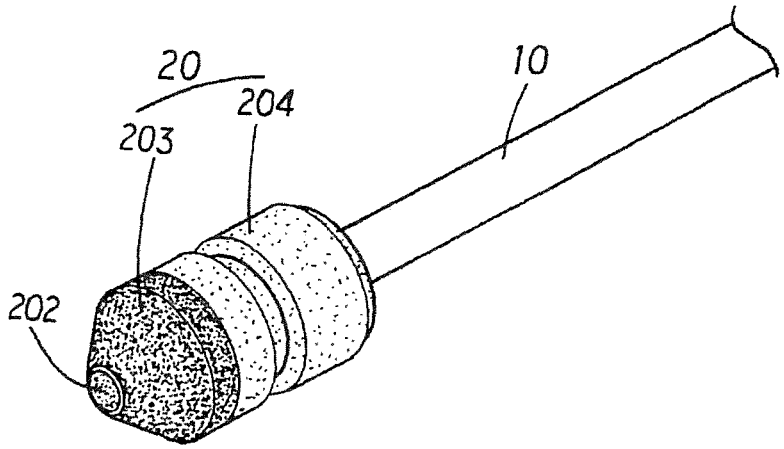
FIG. 3 is a perspective view of a plug of an artificial insemination tube for livestock breeding in accordance with a preferred embodiment of this disclosure.
Figure 4:
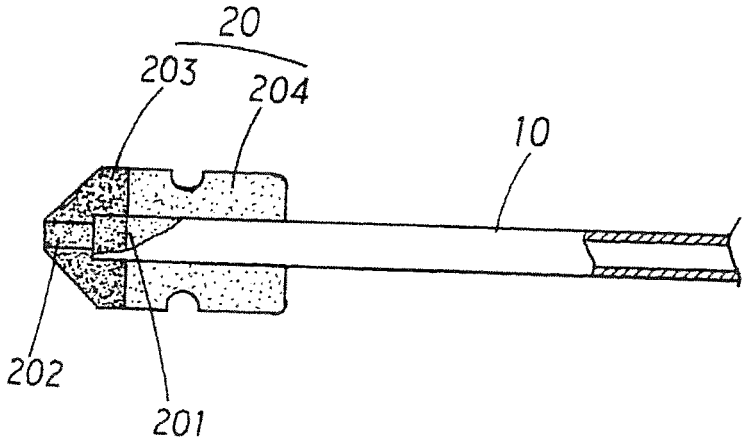
FIG. 4 is a front view of the plug as depicted in FIG. 3.

With reference to FIGS. 3 and 4 for a plug of an artificial insemination tube for livestock breeding in accordance with this disclosure, the plug 20 is installed at the front of a sperm delivery duct 10 of an artificial insemination tube, and the plug 20 comprises a leading portion 203 and a viewing portion 204, wherein the leading portion 203 and the viewing portion 204 are integrally formed by stacking foam layers formed by foaming a foam material (such as ethylene vinyl acetate (EVA)), and the leading portion 203 and viewing portion 204 formed by stacking the foam layers have different hardness layers or color layers. Wherein, each of the leading portion 203 and the viewing portion 204 of the plug 20 has one or more foam layers.

After the leading portion 203 and the viewing portion 204 of the plug 20 are stacked and combined with each other, an injection hole 202 is formed at the leading portion 203, and a sleeve aperture 201 is formed between the leading portion 203 and the viewing portion 204 and communicated with the injection hole 202, and the sleeve aperture 201 is provided for installing the sperm delivery duct 10.

Wherein, the leading portion 203 of the plug 20 is formed by foaming a foam material, which is a hard layer with a relatively better hardness, and the peripheral surface of the hard layer has better density and smoothness.

Wherein, the viewing portion 204 of the plug 20 is formed by foaming a foam material, which is a soft layer softer than the leading portion 203.

Wherein, the leading portion 203 and the viewing portion 204 of the plug 20 are formed by different color layers, and made of stacking the foam materials of different colors, or coating different color films onto the peripheral surface of the plug 20 after the foaming and forming processes.

Figure 5:
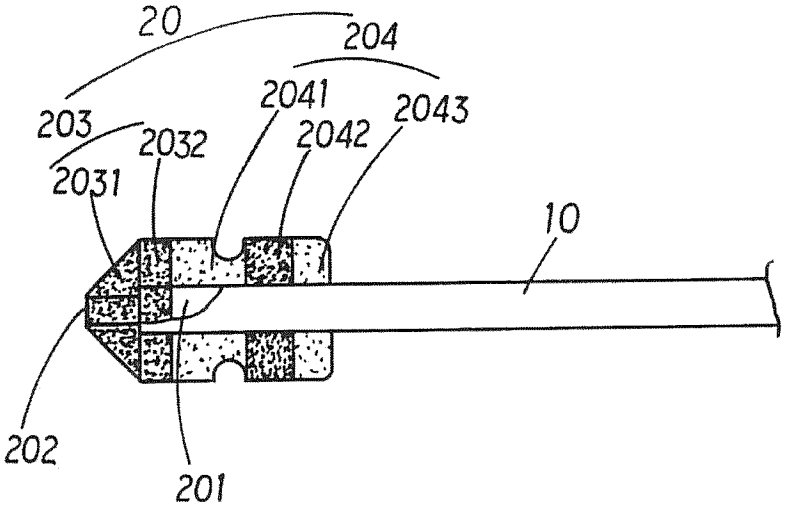
FIG. 5 is a front view of a plug of another preferred embodiment of this disclosure.

Wherein, the leading portion 203 and the viewing portion 204 of the plug 20 are formed by stacking and combining single-layer foams into a plug 20. With reference to FIG. 5, the leading portion 203 of the plug 20 may be formed by foaming and stacking a plurality of layers of foams 2031, 2032, and the viewing portion 204 of the plug 20 may be formed by foaming and stacking a plurality of layers of foams 2041, 2042, 2043. Each layer of foams 2031, 2032 in the leading portion 203 and each layer of foams 2041, 2042, 2043 in the viewing portion 204 may be a different color layer, and each layer of foams 2041, 2042, 2043 in the viewing portion 204 may be a different hardness layer. In addition, after the leading portion 203 and the viewing portion 204 are foamed and stacked to form the plug 20, the leading portion 203 is a hard layer.

In an artificial insemination of a livestock, the plug 20 installed at the front of the sperm delivery duct 10 is inserted into the livestock vagina slowly, and the leading portion 203 of the plug 20 is a hard layer, so that the leading portion 203 of the plug 20 pushed and entered into the female livestock body will not be deformed easily, so that the injection hole 202 formed at the leading portion 203 will not be deformed, decreased, narrowed, or blocked. After the plug 20 enters into the uterus of the livestock and a user injects semen of the livestock stored in a semen bottle or bag (not shown in the figure) which is installed at the rear of the sperm delivery duct 10 into the sperm delivery duct 10, the livestock semen contained in the sperm delivery duct 10 can enter smoothly and quickly into the female livestock body through the injection hole 202 of the plug 20 to achieve the effect of improving the smoothness and efficiency of the artificial insemination. Of course, the leading portion 203 of the plug 20 is a hard layer with greater density and smoothness, so that the plug 20 can be entered into the female livestock body more easily and smoothly during the artificial insemination procedure, and the female livestock body will not produce repellence.

In the artificial insemination for livestock breeding, the plug 20 of an artificial insemination tube is inserted slowly along the livestock vagina into the uterus, and then removed after the artificial insemination procedure ends. Since the secretion or other fluid of the female livestock body will be attached onto the peripheral surface of the plug 20 automatically and the leading portion 203 and the viewing portion 204 of the plug 20 have different color layers, and the predetermined different color layers are provided for showing the color of the secretion or fluid, therefore a technician carrying out the artificial insemination is naturally capable of detecting the physical and physiological conditions of the livestock clearly and conveniently to achieve the effects of preventing illness and controlling the first opportunity of curing. If the livestock is injured accidentally while the artificial insemination tube is being extended into the female livestock body, blood stains may be attached onto the peripheral surface of the light colored leading portion 203 or viewing portion 204 of the plug 20, so that we can know the situation clearly and take care of the situation immediately to achieve the early treatment effect. In addition, the secretion of a healthy female livestock body is generally transparent, and any colored secretion attached onto the peripheral surface of the dark colored leading portion 203 or viewing portion 204 of the plug 20 indicates a poor physical or physical condition of the female livestock body, so that we can know the situation clearly and handle the situation immediately.

In other words, the plug of an artificial insemination tube for livestock breeding of this disclosure has the following advantages:

1. Simple installation and high cost effectiveness.
2. Simple, easy, convenient, and quick operation and use.
3. Highly smooth and efficient artificial insemination for livestock breeding.
4. Applicable for the artificial insemination and the detection of physical and physiological conditions of a female livestock body to provide diversified functions.

What is claimed is:

1. A plug of an artificial insemination tube for livestock breeding, being a plug installed at the front of sperm delivery duct of the artificial insemination tube, comprising;

a leading portion and a viewing portion, both made of a foam material and foamed in stacked relationship one upon the other and coupled integrally, and the foam material of the leading portion and the foam material of the viewing portion being of a different color respectively, the different colors of the leading portion and the viewing portion of the plug being formed by foaming different respective color materials in the stacked relationship.

2. The plug of an artificial insemination tube for livestock breeding according to claim 1, wherein the leading portion of the plug has an injection hole formed therein, and a sleeve aperture is formed between the leading portion and the viewing portion, the sleeve aperture and the injection hole being in open communication with each other.

3. The plug of an artificial insemination tube for livestock breeding according to claim 1, wherein at least one of the leading portion and the viewing portion of the plug is formed by a plurality of layers of foam stacked one upon another.

4. The plug of an artificial insemination tube for livestock breeding according to claim 3, wherein the viewing portion of the plug is formed by the plurality of layers of foam and the plurality of layers have different hardnesses.

5. The plug of an artificial insemination tube for livestock breeding according to claim 1, wherein the leading portion and the viewing portion of the plug are formed by forming an ethylene vinyl acetate foam material.

6. The plug of an artificial insemination tube for livestock breeding according to claim 1, wherein the foam material of the leading portion of the plug is formed with a greater density and hardness than the foam material of the viewing portion.

7. The plug of an artificial insemination tube for livestock breeding according to claim 1, wherein the foam material of the viewing portion of the plug is foamed to be softer than the material of the leading portion.

8. A plug of an artificial insemination tube for livestock breeding, being a plug installed at the front of sperm delivery duct of the artificial insemination tube, comprising: a leading portion and a viewing portion, both made of a foam material and foamed in stacked relationship one upon the other and coupled integrally, and the foam material of the leading portion and the foam material of the viewing portion being of a different color respectively, the different color of the leading portion and the viewing portion of the plug being formed by coating different color films around a peripheral surface of the leading portion and the viewing portion.

9. A plug of an artificial insemination tube for livestock breeding, being a plug installed at the front of sperm delivery duct of the artificial insemination tube, comprising:

a leading portion and a viewing portion, both made of a foam material and foamed in stacked relationship one upon the other and coupled integrally, the leading portion and the viewing portion of the plug being formed by a plurality of layers of foam stacked one upon another, and each layer of the leading portion and the viewing portion being of a different respective color.

* * * * *